United States Patent [19]

Nicolson

[11] 4,160,970

[45] Jul. 10, 1979

[54] ELECTROMAGNETIC WAVE TELEMETRY SYSTEM FOR TRANSMITTING DOWNHOLE PARAMETERS TO LOCATIONS THEREABOVE

[75] Inventor: Alexander M. Nicolson, Concord, Mass.

[73] Assignee: Sperry Rand Corporation, New York, N.Y.

[21] Appl. No.: 855,095

[22] Filed: Nov. 25, 1977

[51] Int. Cl.[2] ..... G01V 1/40; H04B 13/02

[52] U.S. Cl. ..... 340/18 LD; 166/66; 324/10

[58] Field of Search ..... 340/18 LD, 18 NC; 166/66; 33/312; 324/9, 10; 325/285; 343/848, 849, 719

[56] References Cited

U.S. PATENT DOCUMENTS

| | | | |
|---|---|---|---|
| 2,214,786 | 9/1940 | Bishop | 324/9 |
| 2,411,696 | 11/1946 | Silverman et al. | 340/18 NC |
| 2,568,241 | 9/1951 | Martin | 340/18 NC |
| 3,046,474 | 7/1962 | Arps | 340/18 NC |
| 3,150,321 | 9/1964 | Summers | 340/18 NC |
| 3,215,937 | 11/1965 | Tanner | 325/28 |
| 3,216,016 | 11/1965 | Tanner | 325/28 |
| 3,333,239 | 7/1967 | Silverman | 340/18 NC |
| 4,015,234 | 3/1977 | Krebs | 340/18 LD |

*Primary Examiner*—Nelson Moskowitz
*Attorney, Agent, or Firm*—Howard P. Terry; Seymour Levine

[57] ABSTRACT

A system is disclosed for transmitting information during a borehole drilling operation wherein a section of the drill string near the drill bit is utilized as a transmitting element of an electromagnetic wave propagation system. A receiving system at the surface uses a section of the drill string as one electrode and a metallic ring or ring of probes which penetrate the earth's surface at a given radius from the drill string as another electrode between which signal voltages are detected. In another embodiment, the receiving system comprises metallic rods at the surface which extend radially from the drill string. Signal currents induced in these radially extending rods are detected by a receiver coupled between the rods and the drill string.

4 Claims, 4 Drawing Figures

ELECTROMAGNETIC WAVE TELEMETRY SYSTEM FOR TRANSMITTING DOWNHOLE PARAMETERS TO LOCATIONS THEREABOVE

BACKGROUND OF THE INVENTION

1. Field of the Invention

The invention relates generally to the real time transmission of drilling information to the surface during the drilling operation of a borehole and more particularly relates to an electromagnetic communication system for providing downhole real time drilling parameters at the surface.

2. Description of the Prior Art

Drilling parameters such as drill torque, weight on the drill bit, ambient pressure, and ambient temperature are valuable to a drill rig operator and a search for a reliable method for obtaining this information has continued since the advent of rotor drilling. A prior art technique involved stopping of the drill string, extracting it from the borehole and lowering an instrumentation package in its place. This technique does not provide real time information and only ambient pressures and temperatures are derived thereby which, however, may not be the pressures or temperatures that exist during the drilling operation.

Prior art attempts to develop a drilling telemetry system for providing dynamic information utilized hardwiring or acoustic transmission to transmit downhole drilling information to the surface. One hardwired system utilizes a continuous electrical cable that is lowered inside the drill pipe. An excess cable length is stored on a double loop take-up assembly inside the drill string which is pulled out as additional joints of drill pipe are added. Though this system eliminates the need for an electrical connection for each length of drill pipe, serious problems exist in storing the excess cable length in the drill pipe. Another hardwired system embeds the electrical cable in the walls of the drill pipe and utilizes special connectors manufactured into the tool joints to provide a means of making electrical connections. This system requires a special string of expensive pipe and high reliability of many electrical conductors for efficient operation. In addition to the hardwired electrical systems, acoustic systems in which acoustical waves are launched downhole to propagate along the drill string to be received at the surface were also considered. These systems, however, must compete with acoustic noise that is generated as a result of the drilling operation and generally must extract a signal from a very low signal-to-noise ratio, thus providing a very low probability of signal reception. What is desired is a telemetry system that exhibits a high probability of signal reception without the utilization of additional cables or special drill pipe sections.

SUMMARY OF THE INVENTION

In accordance with the principles of the present invention, a telemetry system operable during drilling operations is realized wherein the drill string, which electrically is a metallic rod, is utilized as a component of an electromagnetic propagation system. An electrically isolated sub containing the electronic circuitry for sensor processing, carrier signal generation, and modulation encoding is inserted in the drill string above the drill bit. A signal voltage is applied across the ends of this unit which establishes an electromagnetic signal that propagates towards the surface through a transmission medium comprising the drill string, the surrounding drilling fluid, and the rock strata for an uncased borehole or the metallic casing and the rock strata for a cased borehole. This electromagnetic signal is received at the surface by sensing a voltage difference between the drill string and a conducting ring or metallic probes at a given radius therefrom or by sensing currents induced in wire conductors extending radially a given distance therefrom. The operating frequency for this electromagnetic telemetry system is a compromise, depending on drill site conditions, between a low frequency at which low propagation losses are realized but at which excessive electrical noise interference is encountered at the receiver and a high frequency at which high propagation losses are realized but at which electrical noise interference at the receiver is minimal.

DESCRIPTION OF THE PREFERRED EMBODIMENTS

Figure 1:
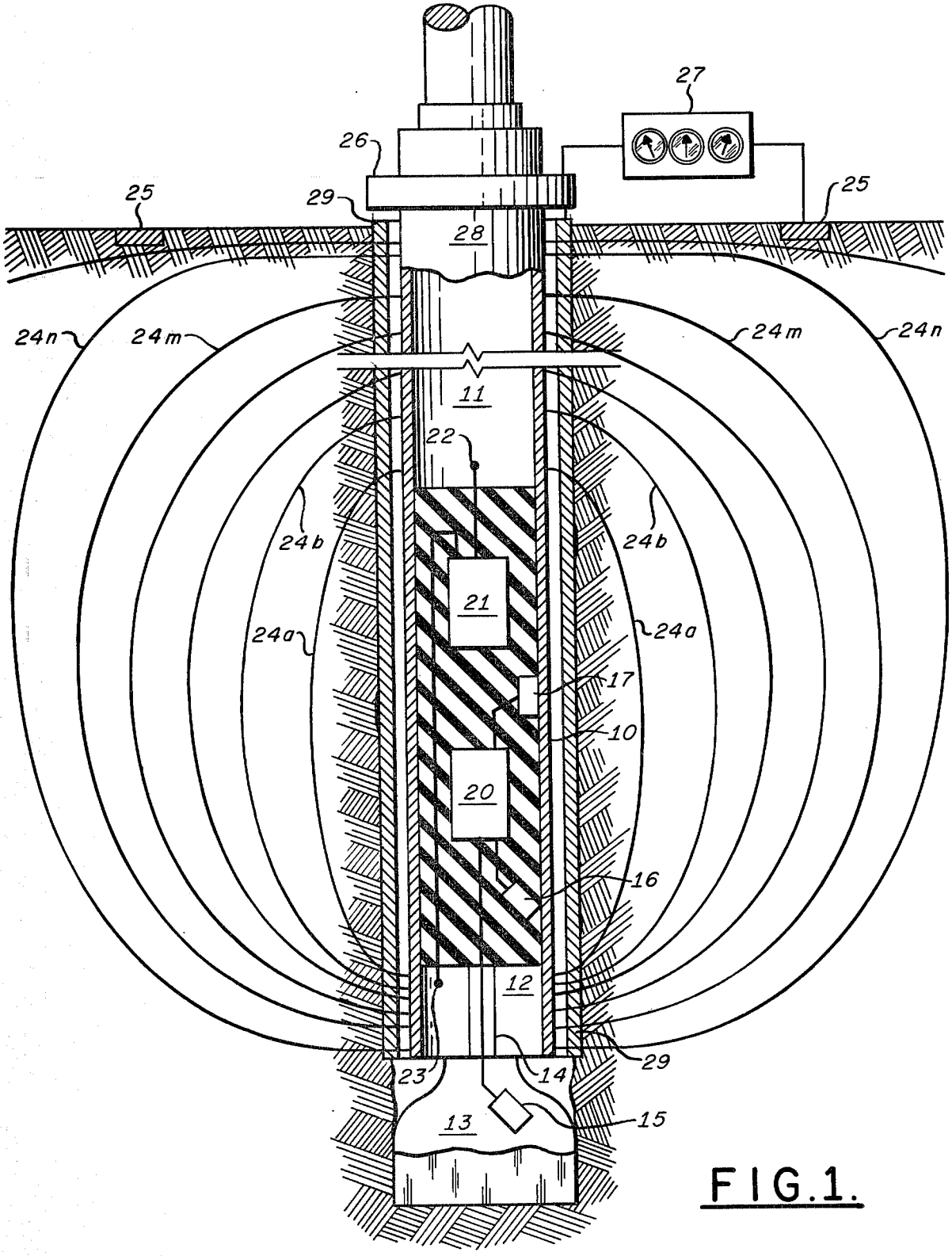
FIG. 1 is a diagram, partially in block form, of one embodiment of a telemetry system employing the principles of the invention on which is also shown generated electric field lines within the earth's strata.
Figure 2:
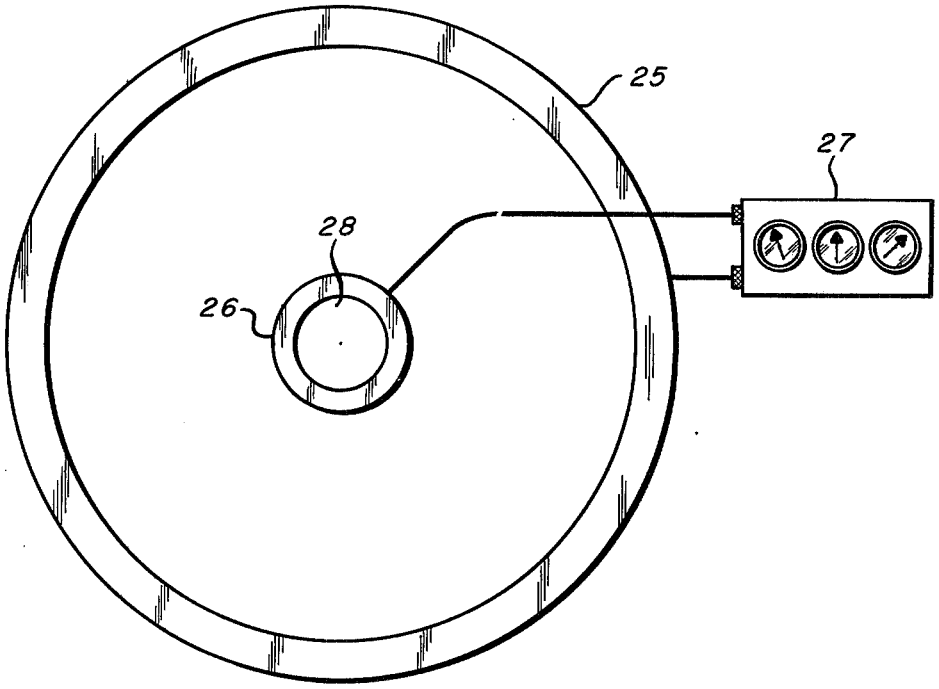
FIG. 2 is a plan view of the drill string, slip rings, and annular electrode useful in explaining the electromagnetic signal reception from the embodiment depicted in FIG. 1.
Figure 3:
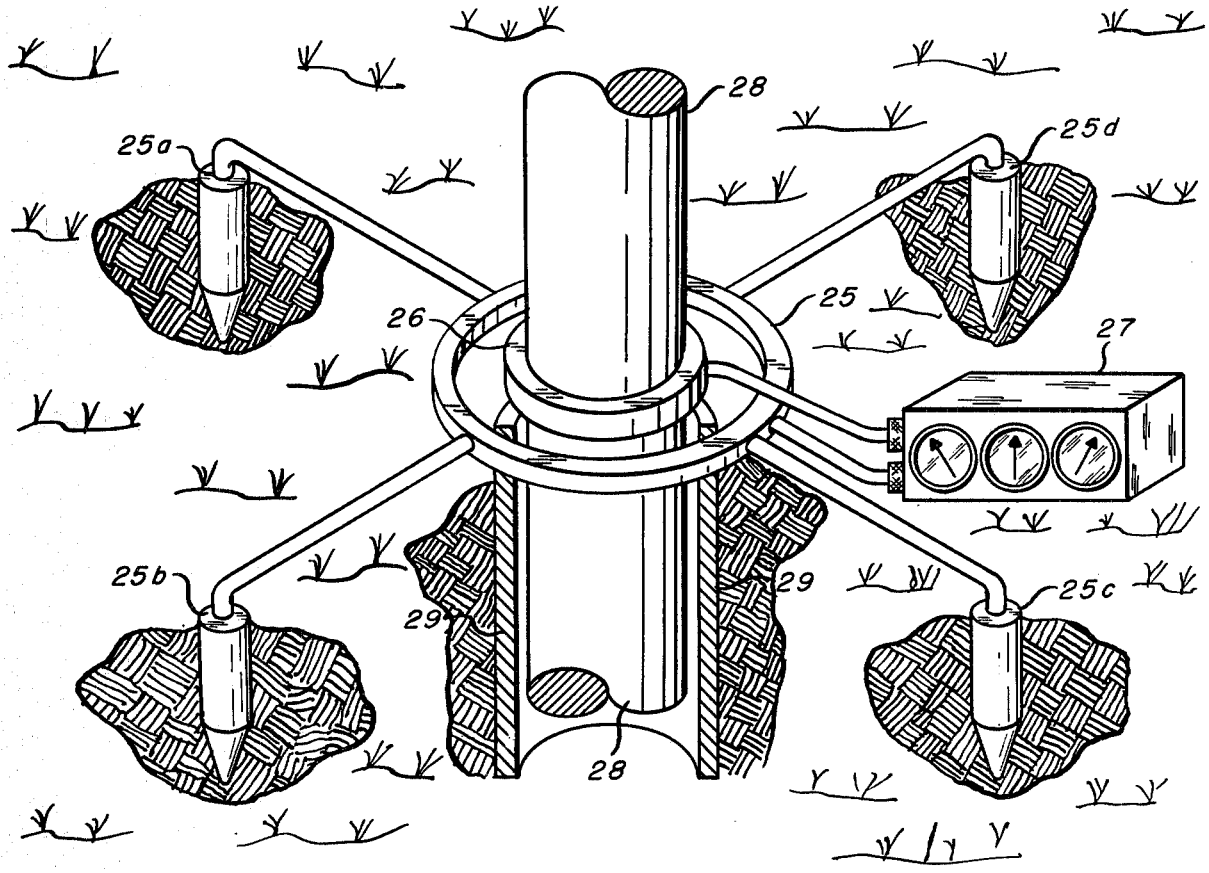
FIG. 3 is a diagram of another embodiment of the invention depicting probes embedded into the earth and positioned diametrically at a given radius from the drill string.

Referring to FIG. 1, an electromagnetic wave telemetry system for drilling includes an insulated sub 10 inserted between sections of the drill string 11 and 12 just above the drill bit 13. Drill string section 12 contains a conduit 14 through which electrical connections may be made to sensors attached to the drill bit 13. Sensors 15, 16 and 17 which monitor such parameters as drill bit torque, drill bit temperature and fluid pressure are coupled to a modulator multiplexer 20 which contains electronic circuitry for combining the signals from sensors 15, 16 and 17 and for providing modulation of the electromagnetic transmitter 21. The output voltage of the electromagnetic transmitter 21 is applied between the upper section 11 and the lower section 12 of the drill string by means of terminals 22 and 23. The voltage applied between the drill string sections 11 and 12 generates an electromagnetic field which propagates outward and upward towards the surface, forming electric field lines 24*a* through 24*n*. An essentially cylindrical configuration of electric field is formed so that a signal voltage may be sensed at the surface between the drill string 28 and some radius out therefrom. Near the surface the electric field lines 24*n* are essentially parallel thereto and extend in this manner radially outward from the drill string 28 for an appreciable distance. Thus, an annular metallic ring 25 positioned coaxially with the drill string 28 and a slip ring 26 which is electrically coupled to the borehole casing 29 and located on, and in electrical contact with, the drill string 28 may be employed as electrodes for sensing the voltage between the drill string 28 and the position of the annular electrode 25. If E is the value of the electric field at the surface and d is the radial distance between the drill string 28 and the annular metallic ring 25, this voltage is determined from the well known equation $V=Ed$. Completion of the receiving system is accomplished by coupling the annular electrode 25 and the slip ring 26 to a receiver 27. The receiving system is shown in plan view in FIG. 2. It will be apparent to those skilled in the art that the annular ring 25 may be approximated by metallic plates which are electrically coupled and each positioned at the proper radius from the drill string or as shown in FIG. 3 by probes 25*a* through 25*d* which may penetrate into the earth with vertical orientation at points which are equidistant from the drill string 28. These probes may be paired with the probes in each pair set diametrically positioned at the appropriate radial distance. These receiving systems provide a degree of noise immunity in that a flat coil, which would be sensitive to magnetic fields normal to the surface, is not employed. These magnetic fields, and electric fields parallel to the surface that are not radial, do not establish a noise voltage between the electrodes, thus enhancing the received signal-to-noise ratio.

Figure 4:
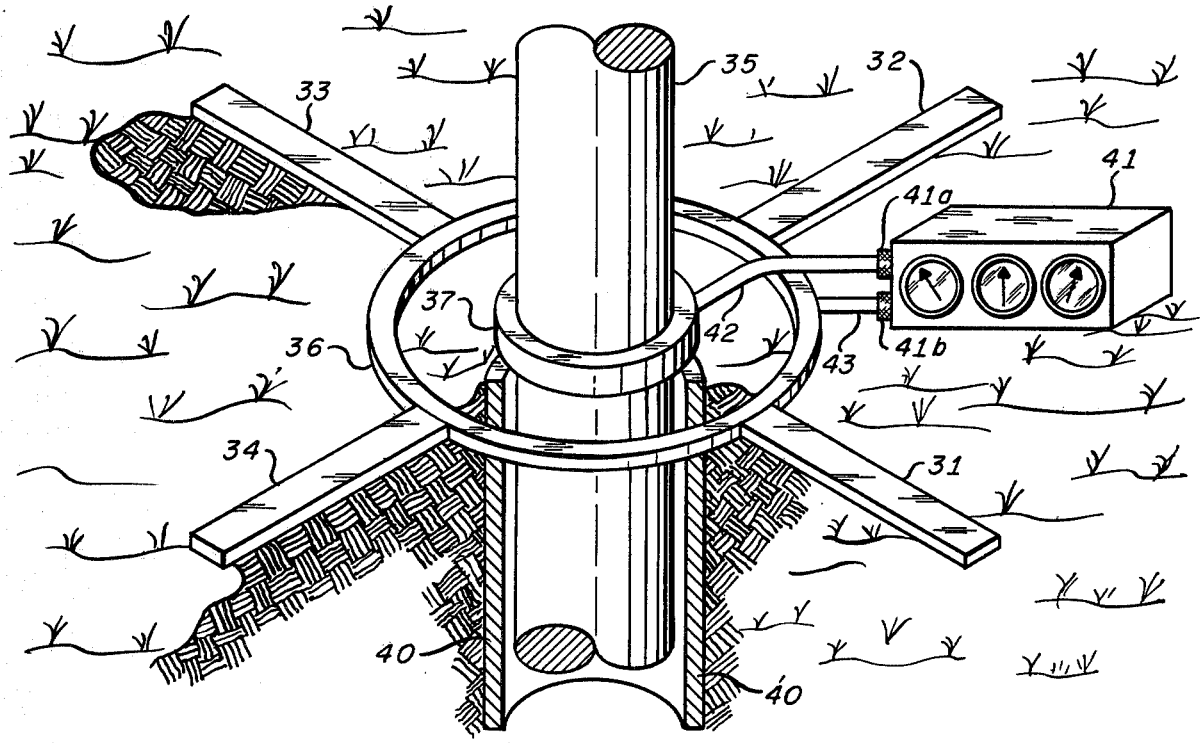
FIG. 4 is a diagram of the reception portion of still another embodiment of the invention depicting linear probes located on the earth's surface which are employed for signal current reception.

Receiving systems which include probe types other than the concentric probes may be employed. Refer to FIG. 4 wherein is shown a receiving system that is the dual of the receiving system described above. Metallic bars 31, 32, 33, 34 which are electrically coupled by means of an electrical conductor 36 extend radially from the drill string 35. A slip ring 37 is electrically coupled to the drill string 35, the borehole casing 40 and to receiver 41 at input terminal 41*a* via an electrical conductor 42, while the electrical conductor 36 is coupled to receiver 41 at input terminal 41*b* via electrical connector 43. The metallic bars 31, 32, 33 and 34 each is parallel to the electric field 24*n*, shown in FIG. 1, which induce a current I in each of the bars 31, 32, 33 and 34, which is given by $I=\sigma aE$ where $\sigma$ is the conductivity of a metallic bar, "a" is its cross-sectional area and E is the value of the electric field. This current is caused to flow in the electrical connector 36 and is coupled to receiver 41 by virtue of the completed circuit comprising electrical connector 36, electrical connector 43, terminal 41*b*, the internal resistance of receiver 41, terminal 41*a*, electrical connector 42, slip ring 37 and a drill string 35. In FIG. 4, four metallic rods are indicated. This number is not critical to the invention and more or less may be utilized. Although a single wire extending radially from the drill string produces a signal amplitude that is substantially of equal magnitude to that of two such rods oriented at ninety degrees, interfering signals are significantly reduced for the latter configuration. The incorporation of a second orthogonal pair of electrodes as shown in FIG. 4 provides still more interference reduction and is consequently a preferred configuration.

While the invention has been described in its preferred embodiment, it is to be understood that the words which have been used are words of description rather than limitation and that changes may be made within the purview of the appended claims without departing from the true scope and spirit of the invention in its broader aspects.

I claim:

1. A telemetry system for transmitting down borehole measured parameters to a receiving location thereabove during the operation of an apparatus of the kind which includes a sectionalized metallic rod substantially extending to the depth of said borehole comprising:

means for exciting a voltage between predetermined adjacent sections of said metallic rod;

means electrically coupled to said metallic rod for sensing electrical signals; and probe means for coupling to an electric field existing at said receiving location in response to said voltage excitation including at least one electrical conductor with preselected cross-sectional dimensions and a length which is greater than each of said cross-sectional dimensions, said length extending radially from a first predetermined distance from said metallic rod continuously to a second predetermined distance therefrom, said at least one electrical conductor being electrically coupled to said signal sensing means whereby currents induced in said at least one radially extending electrical conductor by said electric field are caused to flow through said signal sensing means.

2. A telemetry system in accordance with claim 1 wherein said probe means comprises two electrical conductors each having preselected cross-sectional dimensions and a length which is greater than each of said cross-sectional dimensions, said electrical conductors angularly positioned such that an orthogonal relationship exists therebetween, each electrical conductor extending radially from a first predetermined distance from said metallic rod continuously to a second predetermined distance therefrom.

3. A telemetry system in accordance with claim 1 wherein said probe means comprises four electrical conductors each having preselected cross-sectional dimensions and a length which is greater than each of said cross-sectional dimensions, said electrical conductors extending radially from said metallic rod with equal angular spacing therebetween from a first predetermined distance from said metallic rod continuously to a second predetermined distance therefrom.

4. A telemetry system in accordance with claim 1 further including means for sensing downhole parameters and means coupled to said sensing means and to said voltage excitation means for modulating said voltage excitation means with signals representative of said downhole parameters.

* * * * *